United States Patent [19]

Challis

[11] Patent Number: 5,076,552

[45] Date of Patent: Dec. 31, 1991

[54] ADJUSTABLE VISE

[76] Inventor: Brian Challis, No. 9 Northridge Way, Sandy, Utah 84092

[21] Appl. No.: 515,208

[22] Filed: Apr. 27, 1990

[51] Int. Cl.[5] ..... B25B 1/02

[52] U.S. Cl. ..... 269/6; 269/203; 269/279

[58] Field of Search ..... 269/147–149, 269/228, 165–171.5, 6, 201, 203, 283, 279, 286, 45, 46; 81/487, 367, 129, 382, 371, 373, 150, 153, 422, 423

[56] References Cited

U.S. PATENT DOCUMENTS

| | | | |
|---|---|---|---|
| 1,081,626 | 12/1913 | Peterson | 269/203 |
| 2,040,669 | 5/1936 | Odmark | 269/166 |
| 2,249,651 | 11/1940 | Gilbert . | |
| 2,948,172 | 8/1960 | Sloboda et al. | 269/283 |
| 2,950,912 | 8/1960 | Blackmon et al. | 269/203 |
| 3,836,136 | 9/1974 | Davis . | |
| 4,042,264 | 8/1977 | Shumer | 269/203 |
| 4,083,548 | 4/1978 | Hackbarth . | |
| 4,483,059 | 11/1984 | Dearman . | |
| 4,834,352 | 5/1989 | Thornton . | |
| 4,850,254 | 7/1989 | Burney . | |
| 4,865,496 | 9/1989 | Challis . | |

FOREIGN PATENT DOCUMENTS

| | | | |
|---|---|---|---|
| 225923 | 2/1943 | Switzerland | 269/166 |

*Primary Examiner*—Robert C. Watson

*Attorney, Agent, or Firm*—Thorpe North Western

[57] ABSTRACT

An adjustable vise includes a toggle plier having first and second handles pivotally joined together to move relative to one another, a fixed jaw mounted to extend upwardly from one end of the first handle, a mounting bar pivotally joining the handles together and extending laterally in one direction from the handles generally perpendicular thereto, and a moveable jaw mounted on the bar to slide therealong and to extend upwardly to a spaced-apart position from the fixed jaw so that when the handles are moved apart, the jaws are caused to move away from one another and when the handles are moved together, the jaws are caused to move toward one another. A locking mechanism is mounted on the moveable jaw and is operable to selectively lock the moveable jaw in place on the mounting bar to thereby prevent sliding movement of the moveable jaw, or to unlock the moveable jaw from the mounting bar to allow sliding movement with respect thereto. The moveable jaw includes a channel through which the mounting bar may be inserted, at least a portion of the channel being shaped to define a wedge-shaped void between a wall of the channel and the mounting bar. The locking mechanism includes a foot having a wedge-shaped section disposable in the channel void and moveable between a first position in which the wedge-shaped section of the foot is in locking contact with the slide bar and the wall of the channel to prevent sliding of the moveable jaw, and a second position in which the wedge-shaped section of the foot is out of contact with the channel wall to allow sliding of the moveable jaw.

18 Claims, 3 Drawing Sheets

ADJUSTABLE VISE

BACKGROUND OF THE INVENTION

This invention relates to an easily adjustable vise capable of holding stair rails and like workpieces, as well as a variety of other articles.

Woodworking and finishing stair rails, accessories and other fine items of woodcraft and construction oftentimes require that the piece being worked upon be held firmly in place while the work is proceeding but yet not held in such a manner that damage, such as vise jaw impressions, scratching, and the like, occurs to the workpiece. Furthermore, the pieces being worked upon oftentimes vary in size and shape so that any equipment used to hold the workpieces beneficially should be able to accommodate the variations in size and shape.

Examples of clamps or tools which have been proposed for holding workpieces of one kind or another include those disclosed in U.S. Pat. Nos. 4,834,352, 2,249,651, 4,483,059, 3,836,136, 4,083,548 and 4,850,254. The tools disclosed in these cited references, although serving some selected needs of the user, nevertheless do not provide the flexibility and adaptability to allow for securely holding a fine crafted workpiece of wood or like material so that the chances of damage to the workpiece are minimized. Further, these tools generally lack the convenience of being able to accommodate a variety of different sizes and shapes of workpieces or of allowing for the convenient positioning of workpieces in multiple orientations to accommodate convenient access to the workpiece.

A number of adjustable vises or clamps have been proposed for use in which the clamps include an elongate bar on which one jaw of a jaw pair is slidable to allow adjusting the spacing between the jaws. Oftentimes the slidable jaw and bar are ratcheted so that the spacing between jaws cannot be continuously varied and the slidable jaw can only be locked in one direction of movement. Alternatively, the slidable jaw may include a thumb screw for locking the jaw in place, but unless the screw is quite large and rugged, it will not securely hold the slidable jaw in place.

SUMMARY OF THE INVENTION

It is an object of the invention to provide a convenient and easy to use clamping tool for holding stair rails and like fine crafted articles, as well as other articles, in various orientations to allow work to be carried out on the articles.

It is another object of the invention to provide such a clamping tool in which articles of various sizes and shapes may be readily clamped or held in place.

It is a further object of the invention to provide such a clamping tool in which workpieces may be held in place without the risk of significant damage or injury occurring to the workpiece.

It is still another object of the invention to provide such a clamping tool which may be easily attached to other fixtures and support structure.

It is an additional object of the invention to provide such a clamping tool which may be readily installed on and removed from a workpiece which is to be held or clamped.

The above and other objects of the invention are realized in a specific illustrative embodiment of an adjustable clamp which includes a toggle plier having first and second handles pivotally joined together to move relative to one another, a fixed jaw mounted to extend upwardly from one end of the first handle, a slide bar pivotally joining the handles together and extending laterally in one direction from the handles generally perpendicular thereto, and a moveable jaw mounted on the slide bar to slide therealong and to extend upwardly to a spaced-apart position from the fixed jaw so that when the handles are moved apart, the jaws are caused to move away from one another, and when the handles are moved together, the jaws are caused to move toward one another. A locking mechanism is mounted on the moveable jaw and is operable to selectively lock the moveable jaw in place on the slide bar to thereby prevent sliding movement of the moveable jaw, or unlock the moveable jaw from the slide bar to allow sliding movement with respect to the bar.

In accordance with one aspect of the invention, compliant gripping pads are mounted on each of the jaws. These gripping pads include two or more contoured surface areas which may be rotated into place on the jaws to contact and hold correspondingly contoured surface areas of a workpiece. The pads are made of a compliant, resilient material to minimize the chance of damage being caused to the workpiece while it is held in place.

In accordance with another aspect of the invention, the moveable jaw includes a channel through which the slide bar may be inserted, with a portion of the channel being shaped to define a wedge-shaped void between a wall of the channel and the slide bar. The locking mechanism comprises a foot having a wedge-shaped portion disposable in the channel void and moveable between a first position in which the wedge-shaped portion of the foot is in locking contact with the slide bar and the channel wall to prevent sliding of the moveable jaw on the slide bar, and a second position in which the foot is out of contact with the channel wall to allow sliding of the moveable jaw on the slide bar.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
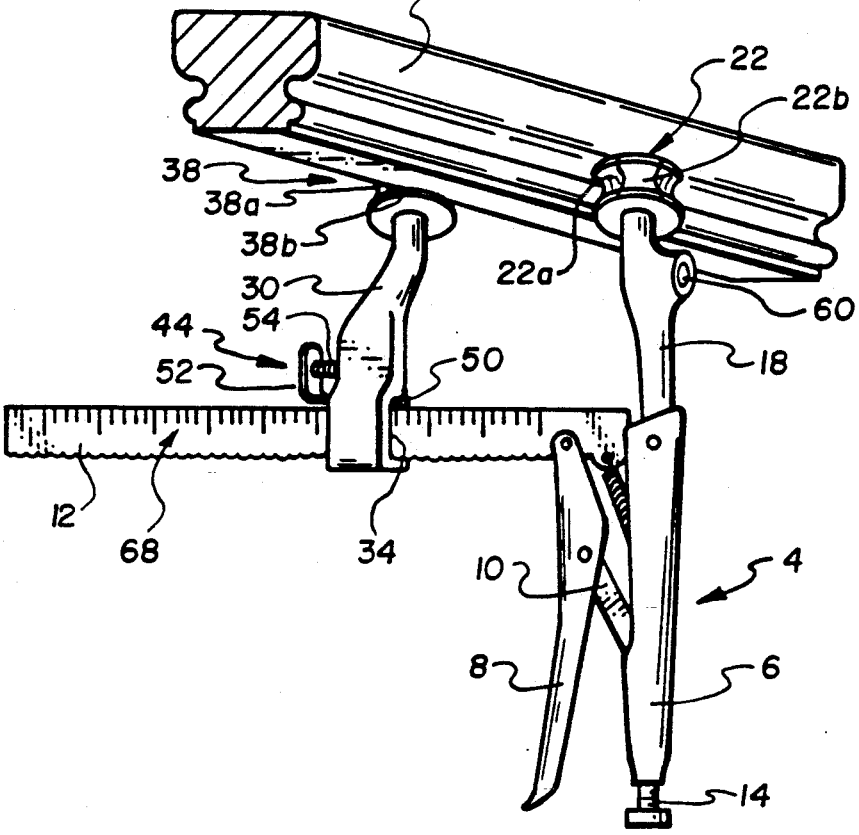
FIG. 1 is a perspective view of an adjustable vise for holding stair rails and the like made in accordance with the principles of the present invention.
Figure 2:
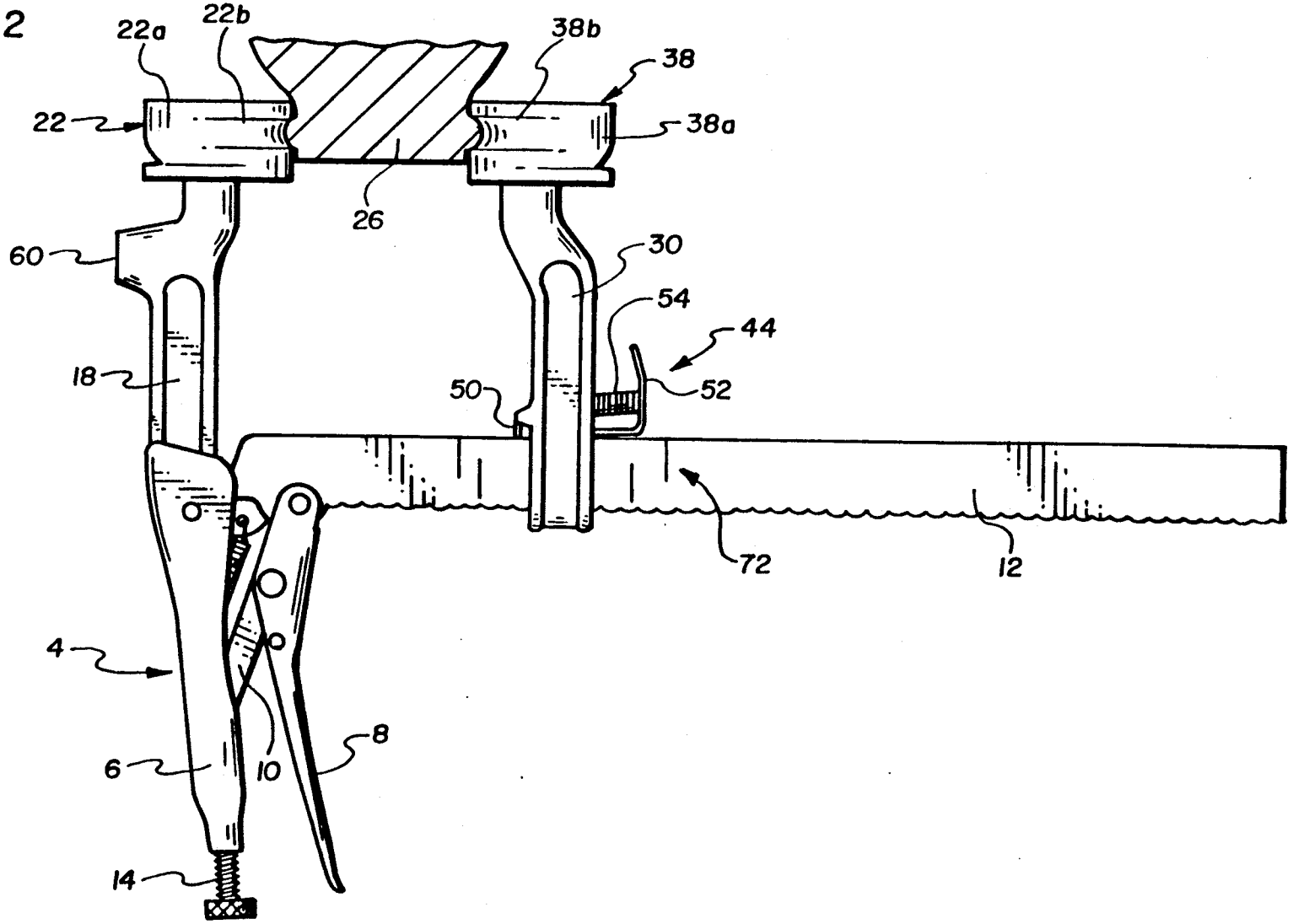
FIG. 2 is a side, elevational view of the vise of FIG. 1 in the clamped position.
Figure 3:
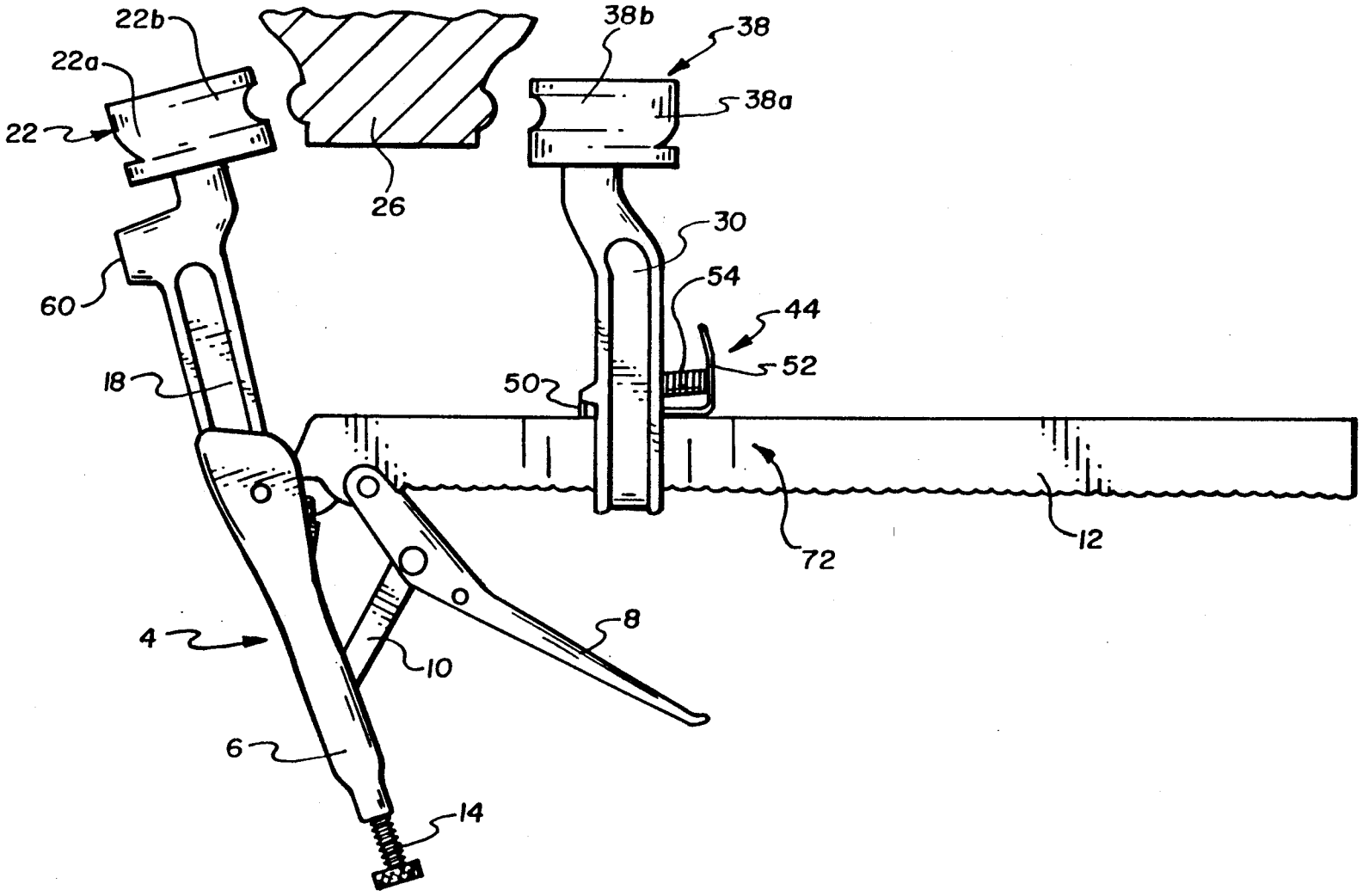
FIG. 3 is a side, elevational view of the vise of FIG. 1 in the unclamped position.

Referring to FIGS. 1-3, there is shown a specific illustrative embodiment of an adjustable vise which includes a conventional toggle plier 4 having a fixed handle 6 and a moveable or pivoting handle 8. The handles 6 and 8 are pivotally joined together by a brace 10 in a conventional fashion, and by a mounting bar 12 which is pivotally joined to upper or working ends of the handles 6 and 8 so that the bar extends laterally from both of the handles as shown. Disposed in the fixed handle 6 is a conventional adjustment screw 14 for adjusting the extent to which the working ends of the handles are caused to move apart when the lower gripping portions of the handles are moved apart and vise versa.

The effect of moving the handles apart or together is best seen in FIGS. 2 and 3, with FIG. 2 showing the adjustable vise when the handles are positioned together in the clamped position and FIG. 3 showing the adjustable vise when the handles are positioned apart in the unclamped position.

Mounted to extend upwardly from the fixed handle 6 is a fixed jaw 18 on the upper end of which is rotatably mounted a compliant, resilient, gripping pad 22. The gripping pad 22 includes a plurality of differently contoured and shaped surface areas 22*a*, 22*b*, etc. which may be selectively rotated to face and contact a workpiece such as stair rail 26. The different surface areas 22*a*, 22*b*, etc. are specifically contoured to accommodate correspondingly contoured workpieces. Advantageously, the gripping pad 22 is made of semi-hard rubber to contact and grip the workpiece without causing damage to it.

Slidably disposed on the mounting bar 12 and extending upwardly therefrom is a moveable jaw 30. The moveable jaw 30 and fixed jaw 18 extend generally parallel with one another and terminate at upper ends which are laterally spaced apart from one another. The lower end of the moveable jaw 30 includes a channel 34 through which the mounting bar 12 is inserted. Mounted on the upper end of the moveable jaw 30 is a compliant, resilient gripping pad 38 (similar to gripping pad 22) which is rotatable to present a selected one of a plurality of different shaped and contoured surface areas 38*a*, 38*b*, etc. toward the other gripping pad 22.

Figure 4:
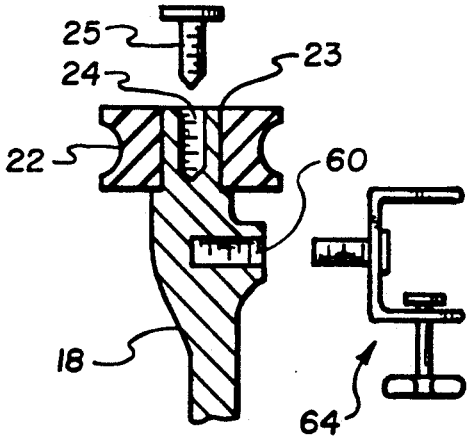
FIG. 4 is a side, elevational, cross-sectional, partially fragmented view of one of the jaws and gripping pads of the vise of FIG. 1.

FIG. 4 shows a side elevational, cross-sectional and partially fragmented view of the jaw 18 of FIG. 1, and the gripping pad 22. The gripping pad 22 is formed in the shape of a multisided annulus having an opening 23 into which the upper end of the jaw 18 may be inserted. A threaded bore 24 is formed in the top of the jaw 18 for screwably receiving a correspondingly threaded screw 25 to hold the pad 22 in place on the jaw. The head of the screw 25 is larger than the opening 23 of the pad 22 and so the pad is prevented from sliding off the jaw 18.

Figure 5:
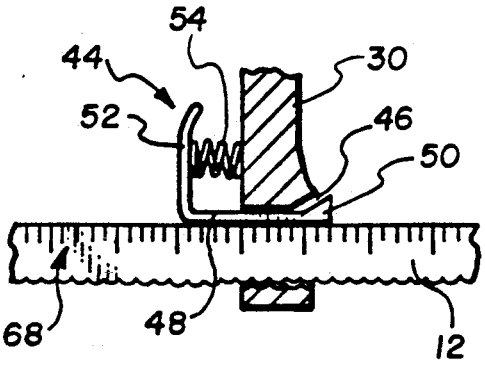
FIG. 5 is a cross-sectional, partially fragmented view of the locking mechanism of the vise of FIG. 1

The moveable jaw 30 is held in place at selected positions along the mounting bar 12 by a locking mechanism 44. The locking mechanism 44 operates in conjunction with the channel 34 formed in the moveable jaw 30. A portion of this channel is formed to define a wedge-shaped void 46 (best seen in FIG. 5) located on one side of the moveable jaw. The locking mechanism 44 includes a foot 48 disposed in the channel 34 on top of the mounting bar 12, and includes a wedge-shaped end section 50. Extending upwardly from the foot 48 from the end thereof opposite the end section 50 is a thumb tab 52. The thumb tab 52 extends generally parallel with the moveable jaw 30. A coil spring 54 is disposed to extend between the moveable jaw 30 and the thumb tab 52 to normally bias and force the thumb tab away from the moveable jaw. When this is allowed to occur, the wedge-shaped section 50 of the foot 48 is caused to move into the wedge-shaped void 46 and make locking contact with the upper channel wall of the void, as well as with the upper edge of the mounting bar 12, so that the lower edge of the mounting bar is forced downwardly onto the lower wall of the channel 34 which thereby inhibits sliding movement of the moveable jaw 30. The lower edge of the mounting bar 12 is advantageously serrated or roughened to provide better frictional contact with the lower wall of the channel 34 to even better inhibit movement of the moveable jaw 30. In this circumstance, the moveable jaw 30 is locked in place.

When it is desired to move the moveable jaw 30, the thumb tab 52 is pressed toward the moveable jaw to thereby move the wedge-shaped section 50 of the foot 48 out of the wedge-shaped void 46, to thereby move the foot out of contact with the upper wall of the void, and allow sliding movement of the moveable jaw along the mounting bar 12. When the next desired position for the moveable jaw 30 is reached, the thumb tab 52 is released to again lock the moveable jaw into position.

The locking mechanism 44 locks the moveable jaw 30 against movement in either direction and also allows movement in either direction when released. The construction of the locking mechanism 44 provides for locking the moveable jaw 30 in place without the need for a "resistant pressure" from the workpiece being held (such as stair rail 26) which is oftentimes required in state-of-the-art clamping tools.

Formed in the fixed jaw 18 is a threaded lug bore 60 into which a correspondingly threaded fixture, bolt, or support structure such as assembly 64 in FIG. 4. The adjustable vise of the drawings may then be held in place by simply properly securing the fixture, bolt or support structure screwed into the lug bore 60. Because the fixed jaw 18 may be rotated relative to the fixture screwed into the lug bore 60, the adjustable vise of the drawings may be positioned in a variety of orientations to allow better access to the workpiece being held by the vise. Although the lug bore 60 is shown to extend generally transversely of the fixed jaw 18, it should be understood that a variety of locations and orientations for the lug bore could be utilized.

Formed or inscribed on one side of the mounting bar 12 is a scale 68 calibrated so that when a selected side of the moveable jaw 30 is positioned over some part of the scale, that part provides a reading of the spacing between at least certain facing surface areas of the gripping pads 22 and 38 when the vise is in the clamped position (FIG. 2). Thus, if the width of the workpiece to be held by the vise is known, the moveable jaw 30 can be prepositioned at a location on the scale 68 which corresponds to the width of the workpiece and then the clamp can be placed on the workpiece. For example, for placing the clamp on stair rail 26, the gripping pads 22 and 38 would be rotated so that similarly contoured surface areas of the gripping pads were positioned in facing relationship to receive and contact opposite sides of the stair rail. The moveable jaw 30 would then be moved to a position on the scale 68 which indicated the width of the portion of the stair rail 26 to be clamped. All this would be carried out with the adjustable vise of the drawings positioned in the unclamped position shown in FIG. 3. The vise would then be moved into position so that the gripping pads 22 and 38 were generally positioned on opposite sides of the stair rail (as shown in FIG. 3) and then the handles 6 and 8 of the toggle plier 4 would be closed to cause the mounting bar 12 to pivot upwardly and thereby cause the fixed jaw 18 and moveable jaw 30 to move towards one another to allow the gripping pads to contact and hold the stair rail (FIG. 2).

A scale 72 is inscribed on the other side of the mounting bar 12 (FIGS. 2 and 3) and includes individual markings to indicate where the jaw 30 can be positioned to securely grip different types or style stair rails (or other articles). These markings are uniquely positioned for the different type stair rails to be held by the vise, and so the vise may be quickly adjusted in preparation for clamping each of the different stair rails having markings on the bar 12.

In the manner described, a simple and easy-to-use adjustable vise is provided for clamping and holding stair rails, like fine crafted articles, and other articles. Course adjustments in the spacing between gripping pads is made by sliding the moveable jaw 30 along the mounting bar 12, and more fine adjustments to such spacing may be made using the adjustment screw 14. The locking mechanism 44 allows for the secure locking of the moveable jaw 30 on the mounting bar 12 and allows for the easy, single operation unlocking of the mechanism to thereby allow movement in either direction on the mounting bar. The lug bore 60 allows for attaching the adjustable clamp to a fixture or other support structure which would then support and hold both the adjustable clamp and any article held by the clamp.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. An adjustable vise comprising a toggle plier having a fixed handle with a working end, and a moveable handle also with a working end, said moveable handle being pivotally joined to the fixed handle, a first jaw mounted to extend upwardly from the working end of the fixed handle to terminate at a free end, a mounting bar pivotally joining the working ends of the handles and extending laterally in one direction therefrom to pivot downwardly when the handles are moved apart and upwardly when the handles are moved together, a second jaw mounted on the bar to slide therealong and to extend upwardly in an adjustable spaced-apart relationship with the first jaw to also terminate at a free end, so that when the handles are moved apart, the second jaw is caused to move away from and downwardly from the first jaw, and when the handles are moved together, the second jaw is caused to move upwardly and toward the first jaw, first and second gripping pads rotatably mounted on the free ends of the first and second jaws respectively, each gripping pad comprising a body having a plurality of differently contoured sides, each of which may be rotatably positioned to generally face the other pad body, and a threaded lugbore formed in the first jaw for receiving a compatibly threaded support fixture.

2. A vise as in claim 1 wherein said gripping pads each include an opening formed coincident with the rotation axis of said each pad, said vise further comprising first and second threaded bores formed in the free ends of the first and second jaws respectively, and first and second screws screwable into the first and second threaded bores respectively to hold the gripping pads in rotatable disposition on the free ends of the jaws.

3. A vise as in claim 1 wherein the gripping pads are composed of a compliant, resilient material.

4. A vise as in claim 3 wherein the gripping pads are composed of rubber.

5. A vise as in claim 1 wherein said threaded lug is disposed generally transversely of the first jaw.

6. A vise as in claim 1 further comprising a scale formed on a side of the mounting bar to indicate the distance between at least two facing sides of the gripping pads at a location on the scale occupied by the second jaw.

7. A vise as in claim 6 further comprising markings formed on another side of the mounting bar to indicate appropriate spacing between the first and second jaws for gripping certain articles, when the second jaw is positioned adjacent markings formed for those articles.

8. A vise as in claim 1 further including lock means mounted on the second jaw and actuable to lock the second jaw in place on the mounting bar and prevent sliding movement of the second jaw.

9. A vise as in claim 8 wherein said second jaw includes a channel formed at a lower end thereof through which the mounting bar may be inserted, at least a portion of said channel being formed to define a wedge-shape void above the mounting bar when the second jaw is placed on the mounting bar, said void having a top wall, and wherein said lock means includes a foot having a wedge-shaped section disposable in the channel void above the mounting bar and moveable between a first position, in which the wedge-shaped section of the foot is in locking contact with the top of the mounting bar and top wall of the void to prevent sliding of the second jaw on the mounting bar, and a second position, in which the wedge-shaped section of the foot is out of contact with either the top of the mounting bar, top wall of the void, or both to allow sliding of the second jaw on the mounting bar.

10. A vise as in claim 9 wherein said lock means further includes a thumb tab joined at one end to one end of the foot, and extending upwardly generally alongside the second jaw so that when the thumb tab is pushed toward the second jaw, the foot is moved to the second position, and when the thumb tab is pushed away from the second jaw, the foot is moved to the first position.

11. A vise as in claim 10 wherein said lock means further includes a spring disposed between the thumb tab and second jaw to bias the thumb tab away from the second jaw.

12. A vise as in claim 11 wherein the bottom edge of the mounting bar includes serrations therealong to inhibit free sliding of the second jaw along the mounting bar.

13. An adjustable vise comprising a toggle plier having first and second handles pivotally joined together to move relative to one another, a fixed jaw mounted to extend upwardly from one end of the first handle, a mounting bar pivotally joining the handles together and extending laterally in one direction from the handles generally perpendicular thereto, a moveable jaw mounted on the bar to slide therealong and to extend upwardly to a spaced-apart position from the fixed jaw so that when the handles are moved apart, the jaws are caused to move away from one another, and when the handles are moved together, the jaws are caused to move toward one another, and locking means mounted on the moveable jaw and operable to selectively lock the moveable jaw in place on the mounting bar to thereby prevent sliding movement of the moveable jaw, or to unlock the moveable jaw from the mounting bar to allow sliding movement with respect thereto, wherein said moveable jaw includes a channel through which the mounting bar may be inserted, at least a portion of said channel being shaped to define a wedge-shaped void between a wall of the channel and the mounting bar, with the widest part of the void wedge being coincident with one side of the moveable jaw, said locking means comprising a foot having a wedge-shaped section disposable in the channel void and moveable between a first position in which the wedge-shaped section of the foot is in locking contact with the slide bar and said wall of the channel to prevent sliding of the moveable jaw on the mounting bar, and a second position in which the wedge-shaped section of the foot is out of contact with said channel wall to allow sliding of the moveable jaw on the mounting bar, said locking means further comprising a tab joined at one end to one end of the foot to extend generally at a right angle to the foot so that when the tab is pushed toward the moveable jaw, the foot is moved to the second position and when the tab is pushed away from the moveable jaw, the foot is moved to the first position, and said locking means further including a spring disposed between the tab and moveable jaw to bias the tab in a direction away from the moveable jaw to thereby normally move the foot to the first position.

14. A vise as in claim 13 further including first and second gripping pads, each having at least two gripping surfaces and each being mounted on a different one of the jaws and moveable so that each gripping surface of a gripping pad may be positioned to generally face the gripping pad mounted on the other jaw.

15. A vise as in claim 14 wherein the gripping pads are made of compliant, resilient material.

16. A vise as in claim 14 further comprising a scale formed on a side of the mounting bar to provide a measure of the distance between at least two facing surfaces of the gripping pads, identified as the location on the scale occupied by a portion of the second moveable jaw.

17. A vise as in claim 14 further comprising markings formed on a side of the mounting bar to identify appropriate placements of the moveable jaw on the mounting bar to enable gripping articles whose widths are accommodated for gripping when the moveable jaw is placed adjacent to selected markings.

18. A vise as in claim 13 further comprising a threaded lug bore formed in the fixed jaw for receiving a compatibly threaded support fixture.

* * * * *